US005520613A

United States Patent [19]

Copelan

[11] Patent Number: 5,520,613

[45] Date of Patent: May 28, 1996

[54] RESPIRATORY BREAST TISSUE EXPANDING DEVICE WITH TIMING FUNCTION

[75] Inventor: Rachel Copelan, W. Hollywood, Calif.

[73] Assignee: Naturalife Corporation, Santa Monica, Calif.

[21] Appl. No.: 241,355

[22] Filed: May 11, 1994

[51] Int. Cl.[6] ..... A61H 7/00

[52] U.S. Cl. ..... 601/14; 604/76

[58] Field of Search ..... 601/14, 6, 11; 604/74–76; 606/201, 97–98

[56] References Cited

U.S. PATENT DOCUMENTS

| | | | |
|---|---|---|---|
| 1,312,619 | 8/1919 | D'Orsay | 601/14 |
| 3,841,323 | 10/1974 | Stoughton | 601/14 X |
| 4,584,992 | 4/1986 | Liu | 601/14 |

*Primary Examiner*—Stephen C. Pellegrino
*Assistant Examiner*—Nancy Mulcare
*Attorney, Agent, or Firm*—William H. Maxwell

[57] ABSTRACT

A device for expanding the connective fatty tissue and correcting inverted nipples and improving symmetry of the human breast by means of gentle suction generated by respiratory means. The hollow dome is constructed of tinted, low-density, polyethylene which enables the user to monitor the degree of expansion she desires. The surrounding rim assures an air tight seal with the skin tissue. The pliable, high tensile quality of the hollow dome allows the user to squeeze and change the shape of the hollow dome on various locations on the breast to uplift and improve cleavage. A threaded nipple extends from top center of the exterior of the hollow dome which is attached to a pliable breathing tube and is fitted with a removable mouthpiece to facilitate orally evacuating the air surrounding the breast. A valve-timer controls the input and output of atmospheric pressure which creates a vacuum around the breast, and can be maintained for a selected number of seconds and minutes by the individual needs of the user. A timing function on the valve-timer provides the user with a means of controlling the length of time that vacuum is sustained by activating a start button and ending operation by shutting off the reset stop button. This timing function provides consistency of training and insures operational success.

5 Claims, 3 Drawing Sheets

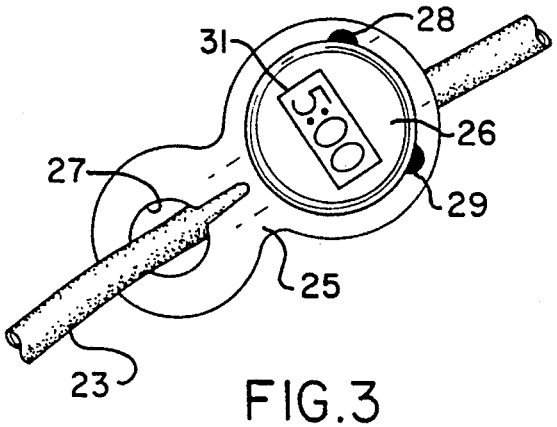
FIG.3
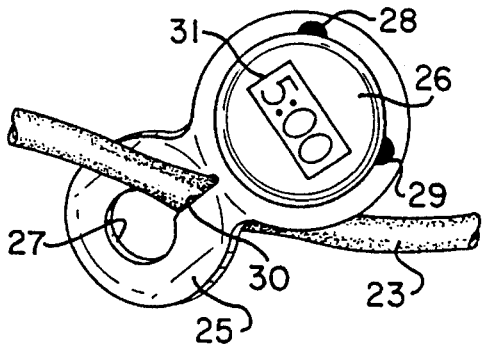
FIG.4
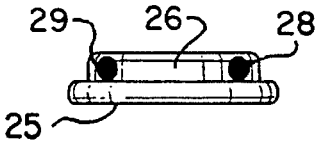
FIG.5
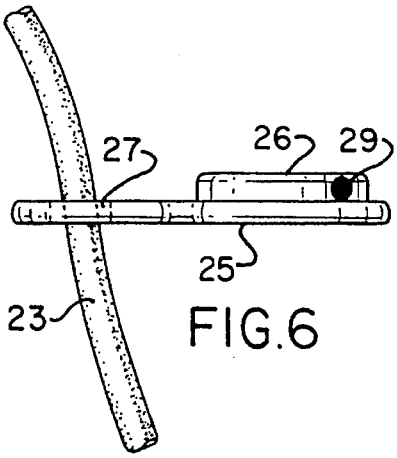
FIG.6
FIG. 7A
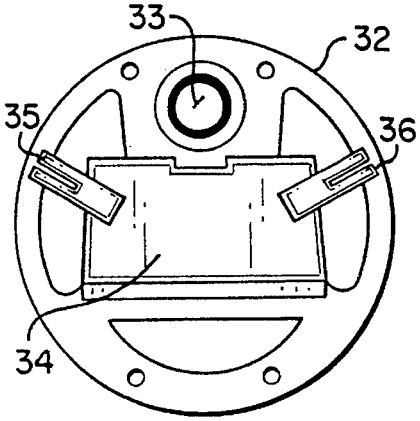
FIG. 7B
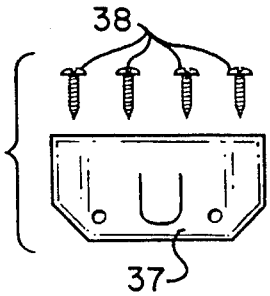
FIG.7C
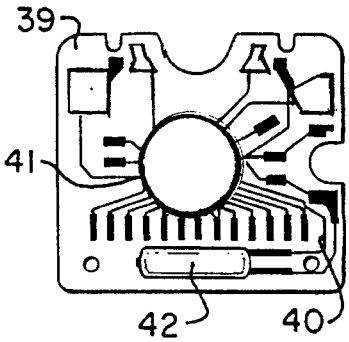

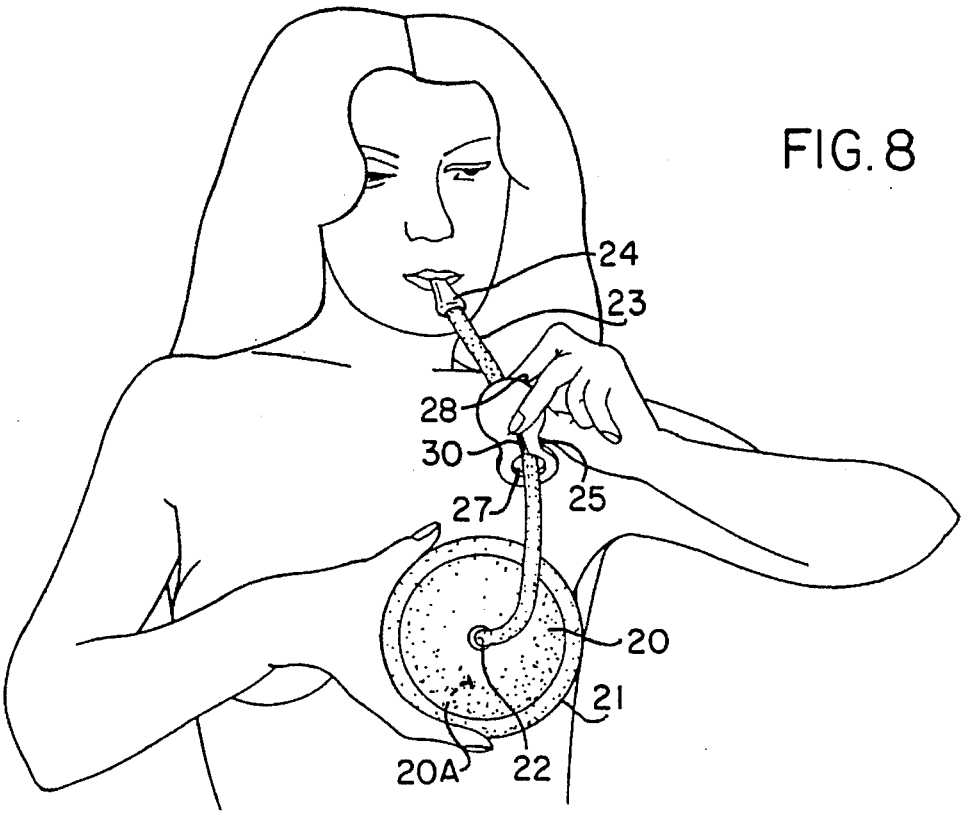
FIG. 8
FIG. 9
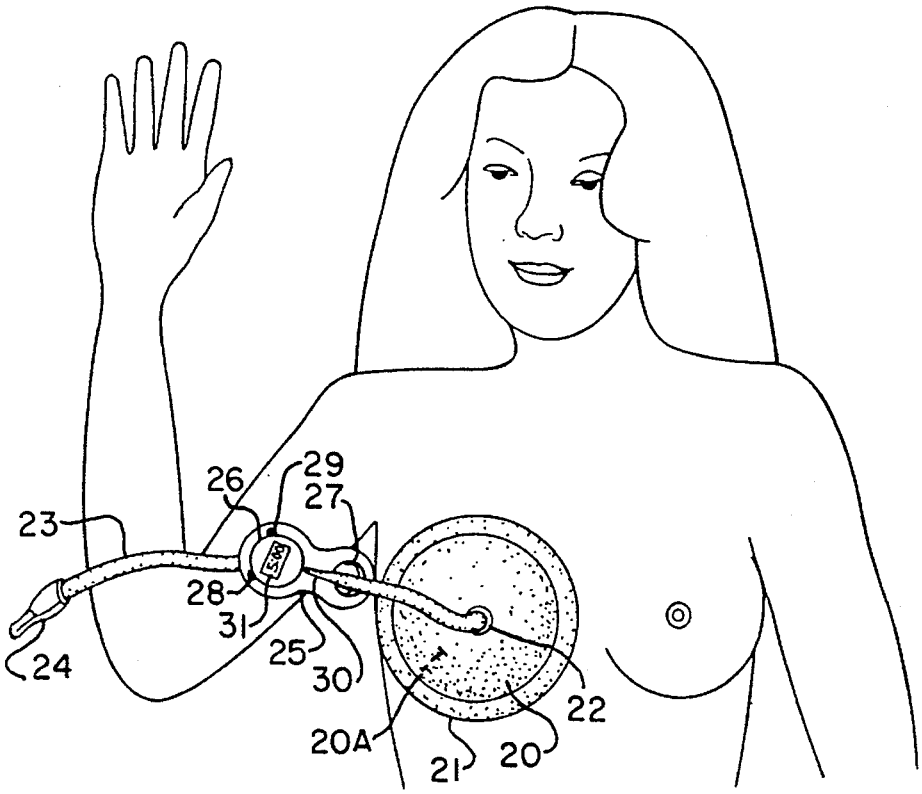

RESPIRATORY BREAST TISSUE EXPANDING DEVICE WITH TIMING FUNCTION

BACKGROUND OF THE INVENTION

1. Field of the Invention

The present invention generally relates to biological tissue stimulating device; and more specifically to a device for expanding connective fatty human breast and nipple tissue.

2. Description of Prior Art

The development of the female breast plays an important role in developing both positive self esteem for women and their ability to nurse offspring. Women have desired to enhance the size and shape of their breasts to look better in clothes and be more sexually desirable to men. Many women experience a secondary aesthetic breast problem of having one breast smaller than the other, resulting in aesthetic disparity between the two breasts. Another secondary aesthetic breast problem is stretch-marks caused by the breast being pulled by gravity over a period of time. In addition, the normal condition of the breast nipple is crucial to women wishing to breast-feed their babies.

The expansion of biological tissue in the female human breast is a well known problem in the medical device field. One medical approach to improve the breast appearance has been to surgically insert silicone implants into the breast region to increase size and fullness. This surgical procedure is an expensive medical operation, and is limited to women who need reconstructive breast surgery. The result of medical research indicates that these devices can negatively effect a women's long term health. Another medical approach is known as hydrotherapy, employing jets of water pulsating the outside of the breast. This approach has had very limited success since the skin of the breast can be damaged by constant external pulsating jets of water. In addition, the internal connective breast tissue is not stimulated deep enough by this approach to create expansion within the breast tissue.

Still another approach to this problem has been nonsurgical suction devices that have attempted to create vacuum pressure within a shape retaining cup. In theory, the vacuum in a retaining cup should result in breast tissue being drawn into the cup for a period of time to facilitate breast expansion. Such prior art devices attempted to create suction by utilizing various types of hand pumps, hydraulics, and electric motors. These devices have also been found to be expensive and difficult to use due to these devices having moving parts that breakdown frequently and their weight placing negative stress on the breast tissue during operation.

In prior art devices that claim to be portable, the evacuation of air is intermittent rather than a steadily maintained suction which is needed to create a controlled prolonged vacuum.

Thus, prior art devices have been ineffective due to their inability to create and maintain the proper level of suction. The design of most prior art devices could create a dangerous level of suction, resulting in stretching and bruising of the breast tissue. In addition, prior art devices have lacked the ability to closely measure the amount of required treatment time. The timing function of the present invention provides the user with the crucial ability to monitor the treatment duration. A novel feature of the present invention allows the user to gradually increase the safe use of the breast expansion device. In addition, it provides the user free movement due to its portability while it is performing the breast expansion treatment. This is an important factor to assure a noticeable change in the size and shape of the breast tissue.

Prior art devices also indicated that around fifteen minutes per breast each day was necessary to affect, if any, change in the breast tissue region. The present invention regulates the time needed to perform the breast expansion activity and can be accomplished in 5 minutes or less each day.

In addition, the ability of user to monitor the exact amount of time used for each breast is beneficial to those women that may need to equalize the size and shape of their breasts. This improvement represents a significant improvement over prior art and is the result of the present invention utilizing respiratory suction with a timing function. This mouth breathing technique not only causes a vacuum for breast tissue expansion, but also expands the capacity of respiration which helps increase the lung capacity and pectoral muscular platform.

The condition of the breast known as inverted nipples is a major hurdle faced by mothers in their attempt to effectively breast-feed their babies. This inability leads to frustration with both the mother and baby, forcing the infant to be fed from a bottle, limiting the emotion bond so important during nursing.

Treatments to expand inverted breast nipples have included the use of suction generated by breast shields, syringes and breast pumps. These devices have had limited success due to their weight, design and the user's inability to closely measure the time of each treatment, resulting in trauma to the surrounding breast tissue.

The present invention improves upon prior art by incorporating respiratory suction with a timing function to provide a constant vacuum to the breast tissue, thus creating suction in a steady fashion that allows the inverted nipple to expand naturally to its normal position.

The structure of the present invention consists of a low density, high tensile polyethylene hollow dome and surrounding lip, coupled with a breathing tube, mouthpiece and valve-timer. The pliable material and unbreakable construction of the hollow dome allows it to be squeezed and contoured to adjust to the upper chest area as well as the breast itself. This can cause an increase in the cleavage area, resulting in more uplift and firmness. The light weight design of the present invention makes it possible to conform the dome to the body's contour with total sealing strength. Thus, the user's hands may be removed from the device, allowing freedom to apply make-up, brush hair or any other grooming activity. This novel feature of mobility allows the user to maintain a regular exercise program that can help fill the internal fibro-connective fatty tissue of the breast to diminish and make unattractive stretch-marks become less noticeable.

Regardless of the intent of prior art, the present invention improves the ability to create both specific and general suction over the breast. Due to the ability to position the dome, the suction is specific by means of the breathing tube being directly over the nipple. Due to the fact that the device nipple opening is over the breast nipple allows the specific suction and allows for the nipples to expand to natural positions.

This is generated by utilizing a respiratory method that provides an improvement over prior art that could only create sporadic suction which can be dangerous to the user. Because of the lack of a sustained timing function, prior art was unable to both expand internal breast tissue and correct inverted nipples of the breast.

OBJECTS AND ADVANTAGES

The present invention comprises a breast tissue expanding device activated by oral respiration with a self-regulated timing function.

It is therefore the object of the present invention to provide a breast tissue expansion device which has the ability to decrease the amount of treatment time required to expand the size and firm the shape of female breast tissue.

It is still another object of the present invention to provide a breast tissue expansion device which has the ability to safely correct the condition of inverted breast nipples.

It is still another object of the present invention to provide an improved breast tissue expansion device that is easy to disassemble and sanitize.

It is still another object of the present invention to provide an improved breast tissue expansion device that is low cost, durable and easy to use.

It is still another object of the present invention to provide a breast tissue expansion device that incorporates a timing function to insure safety and consistency of training and to assure retention of vacuum for a controlled period of time.

It is still another object of the present invention to provide a breast tissue expansion device that incorporates a timing function which enables women to control the correct amount of time needed to develop matching symmetrical breasts.

It is still another object of the present invention to provide a respiratory breast expansion device that is light weight in design providing mobility and allowing the user's hands to be free for other activities while the device is performing its task.

It is still another object of the present invention to provide a respiratory breast expansion device that because it is portable and light weight in design allows the user to maintain a regular breast expansion program while traveling.

It still another object of the present invention to help fill the internal fatty fibro-connective tissue of the breast to diminish unwanted stretch-marks.

The novel features which are characteristic of the present invention, both as to its organization and method of operation, together with further objectives and advantages thereof, will be better understood from the following description considered in connection with the accompanying drawings in which a presently preferred embodiment of the invention is illustrated by way of example.

It is expressly understood, however, that the drawings are for the purpose of illustration and description only and are not intended as a definition of the limits of the present invention.

BRIEF DESCRIPTION OF THE DRAWINGS

FIG. 3 is a top view of the present invention showing an embodiment of FIG. 1, illustrating the open position of the valve-timer's insert opening allowing the passage of air through the pliable breathing tube.

FIG. 4 is a top view of the present invention showing an embodiment of FIG. 1, illustrating the closed position of the valve-timer's slit closure shutting off the passage of air through the pliable breathing tube.

FIG. 5 is a back view of the present invention showing an embodiment of FIG. 1, illustrating the position of the digital timer activating start and reset stop buttons.

FIG. 6 is a side view of the present invention showing an embodiment of FIG. 1 illustrating, how the timing function is attached to the top of the valve-timer.

FIG. 7A, FIG. 7B and FIG. 7C show according to the present invention an embodiment of FIG. 1 consisting of internal components of a timing function, FIG. 7A illustrating a battery, and a casing platform with digital display, FIG. 7B illustrating a fastener shield with attachment screws, and FIG. 7C illustrating a platform board, printed circuit board layout, semiconductor chip, and capacitor, respectively.

FIG. 8 illustrates the use of the present invention with the hollow dome being squeezed by the user and the valve-timer in the open respiratory position.

FIG. 9 illustrates the use of the present invention with the valve-timer in the shut-off position and timer is set.

DETAILED DESCRIPTION OF THE PRESENTLY PREFERRED EMBODIMENT

Figure 1:
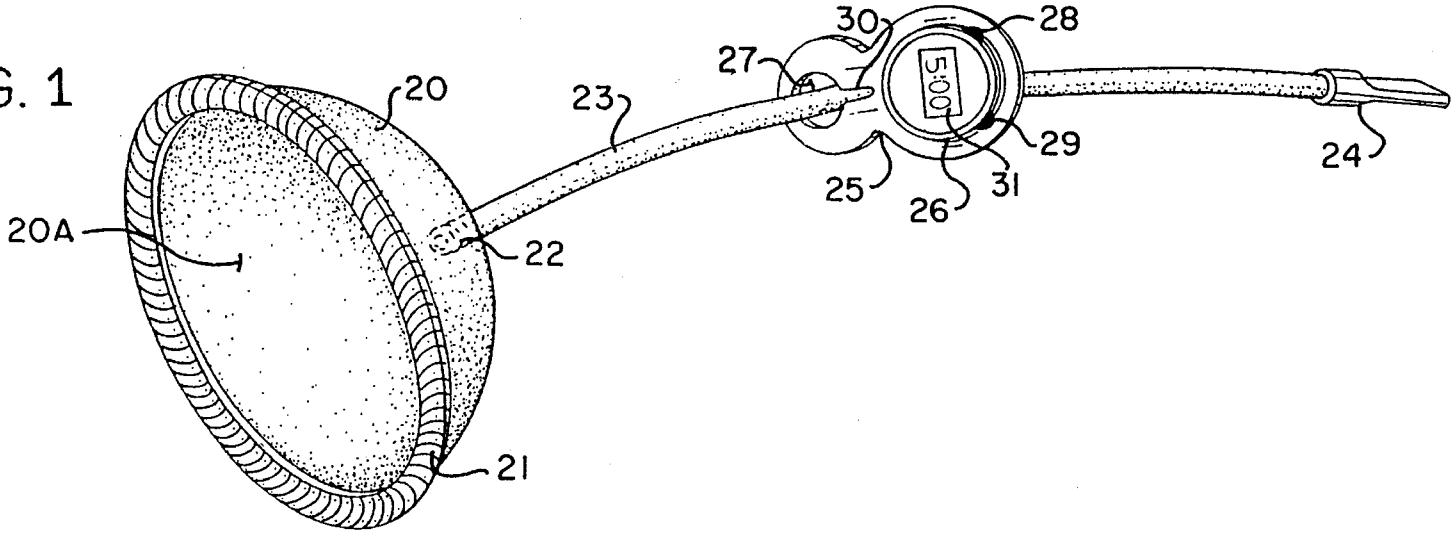
FIG. 1 is a perspective view of the present invention, a respiratory breast tissue expanding device with timing function.

An understanding of the present invention can be best gained by reference to FIGS. 1 through 9. Referring now to FIG. 1, the present invention employs a hollow dome 20 which is to be placed over the breast tissue making contact only with the surrounding skin, not the breast itself.

The hollow dome 20 is substantially hemispheric in profile, hollow in the interior 20*a* and employs a surrounding rim 21 which is textured in design and pliable to allow for adhering to the skin of the chest, thus avoiding contact with the skin of the breast. A threaded nipple 22 located at the top of the center of the hollow dome 20 is coupled to a pliable breathing tube 23 by screwing with clockwise turns until pliable breathing tube 23 is fully seated on the threaded nipple projection 22. A valve-timer 25 comprised of hourglass shaped rigid plastic and a digital timer 26, and said combination is slid through the insert opening 27 over the pliable breathing tube 23. The valve-timer 25 opens and closes the means for evacuating the atmospheric pressure from the interior 20*a* surrounding the contained breast. A removable mouthpiece 24 is attached by twisting the pliable breathing tube 23 until said removable mouthpiece 24 is seated.

As stated hereinabove, one of the advantages of the present invention over those devices disclosed by prior art is the ability of the user to have greater control to create the correct level of suction around the breast through use of oral respiration rather than by mechanical pumping elements such as manual (hand pump), electrical motor and hydraulic (water pulsating). Prior art has built in obsolescence due to their movable blades and breakable parts that need to be replaced. On the other hand, the present invention due to its simplicity in design is durable and virtually indestructible, providing the consumer with an easy to maintain product. Devices described in prior art have produced sporadic, pulsations of suction too powerful for delicate breast tissue. In contrast, the present invention is as gentle as the nursing of an infant and produces healthy responses in the user rather than the harsh effect of hydraulic, electrical or other mechanical elements of prior art.

In order to avoid the necessity of molding the hollow dome 20 to match the body contour of the user, the hollow dome 20 is pliable to conform, as it is necessary that if the curvature of the female chest. In addition, the material must be solid enough to prevent the escape of air and loss of vacuum.

In addition, to reduce the cost of fabrication it is necessary to eliminate the addition of a separate flexible lip which would have to be mounted around the hollow dome 20. Instead the surrounding rim 21 is molded of the same material and is an integral part of hollow dome 20. Also the surrounding rim 21 is textured to assure a firm, yet gentle grip on the skin which surrounds the breast tissue. This provides for a complete air-tight seal, which is essential for success in a breast expansion device.

The hollow dome 20 is made of a low density polyethylene, thermo-plastic material produced by polymerizing ethylene gas, has been tested and proved to be the best for economy and user friendliness because of its extreme light weight. The total device weighs 2.05 ounces, including the pliable breathing tube 23, a removable mouthpiece 24, and valve-timer 25 and digital timer 26. This is a small fraction of the estimated weight of prior art devices.

Figure 2:
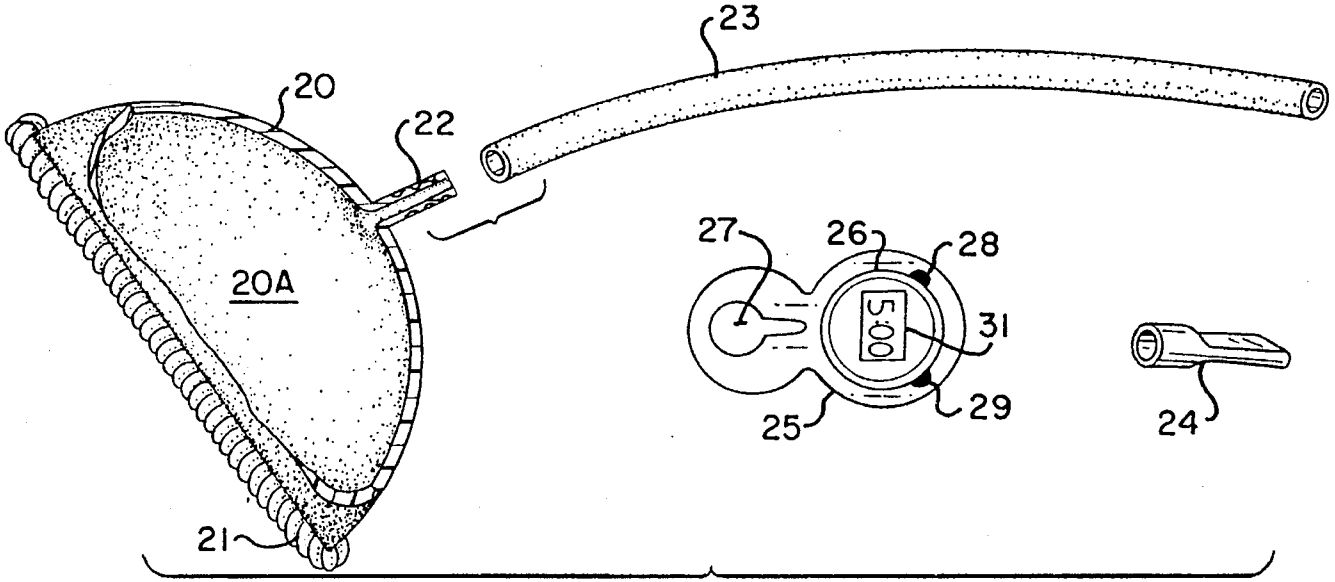
FIG. 2 is a profile view of the present invention showing an embodiment of FIG. 1, illustrating various components and parts which can be easily disassembled.

Referring now to FIG. 2, an exemplary illustration of the ease of disassembly for washing and reassembly. The hollow dome 20 comprises a threaded nipple 22 which is adaptable to be screwed into an end of a pliable breathing tube 23. The pliable breather tune 23 is passed through an insert opening 27 in a valve timer 25 and is connected at its other end to the mouthpiece 24. This modularity of parts allows the device to be disassembled, sanitized and reassembled so that various women within a family can use the same device to avoid the expense of an additional device.

Referring now to FIG. 3, this is a front view of the open position of valve-timer 25 fabricated from rigid plastic in a hourglass shape. The valve-timer 25 has an insert opening 27 through which the pliable breathing tube 23 passes. The insert opening 27 is a round hole that allows the user to start the valve-timer 25 from an open position to create suction by mouth inhalation. A digital timer 26 is located on the valve-timer 25 with an activating start button 28, utilized to begin monitoring the duration of suction activity.

Referring now to FIG. 4, this is a front view of closed position of valve-timer 25 with pliable breathing tube 23 in the slit closure 30 of valve-timer 25. Digital timer 26 can be monitored to guide user as to when the best time to utilize reset stop button 29 to end controlled suction surrounding the breast.

Referring now to FIG. 5, This is the back view of the combined valve-timer 25, showing the position of the digital timer 26 activating start button 28 and reset stop button 29 and the attachment of the digital timer 26 to the top of the valve-timer 25.

Referring now to FIG. 6, this is a side view of the valve-timer 25, illustrating the passage of the pliable breathing tube 23 through insert opening 27. It also shows the digital timer 26 reset stop button 29 as seen in this position.

Referring to FIGS. 7A, 7B, 7C represent the internal mechanisms of digital timer 26 as embodied in FIG. 1., which can be set for five minutes or less.

FIG. 7A shows the casing 32, battery 33 with liquid crystal display 34, Contact metal tabs 35 and 36 control activating start button 28 and reset stop button 29, respectively. which activate digital numbers 1–10 of minutes and digital numbers 1–60 of seconds on digital display 31 as embodied in FIG. 1.

FIG. 7B is the fastener shield 37, with assembly screws 38. This brings the component parts of the timer together to form one unit.

FIG. 7C is a schematic drawing of the platform board 39 of the digital timer 26 which displays the printed circuit board layout 40 as well as the semiconductor chip 41 and capacitor 42.

Referring now to FIG. 8, an exemplary illustration of the use of the present invention is shown. When hollow dome 20 is squeezed and placed over desired location on the user's breast, the surrounding rim 21 will conform to the skin surface around the breast. The user controls the level of suction by coordinating the inhalation of air through removable mouthpiece 24 connected to pliable breathing tube 23 connected to threaded nipple 22 located in the center of hollow dome 20 and exhalation through user's nostrils. The necessary vacuum in the cavity formed between the surface of the breast and the hollow interior of the dome 20 is sustained by producing an air tight seal at the surrounding rim 21 when the user presses down concurrently on valve-timer 25 insert opening 27 and activating start button 28 to move the pliable breathing tube 23 into valve-timer 25 slit closure 30 position, closing off the flow of air through the pliable breathing tube 23.

The breast tissue naturally expands due to the fact that nature abhors a vacuum. The anatomical histological structure of the breasts including the circulatory physiology and principles of tissue development give merit to why this device works over the prior art. The breast has an abundance of space in the non-lactating and post-menstrual female. It also has suspensory ligaments, loose fibro-fatty connective tissue, glandular tissue and circulating fluid channels.

The vacuum pressure created by the device causes seepage of lymph fluid into the abundant interstitial spaces. Of course, when the vacuum pressure is withdrawn, some of this fluid re-absorbs into the lymph channels.

However, repeated fillings of the breast tissue in this manner causes expansion in size due to an increase in individual cell size as well as cell number much like muscle size is increased when exercised in the proper intensity and time duration. Such physical phenomena is known as "Adaption Syndrome" which leads to the greatest results when the user does not exceed the level of exercise that the body can quickly adapt to.

As a result, the timing function of the present invention allows the user greater safety over prior art. Suction generated by the device is monitored during each treatment for 30 seconds per breast on a daily basis. This gradually increases with a 30 second increment per day until a level of 5 minutes per breast is reached. If the user has a problem of asymmetrical breasts, the timer 26 can be set for additional time to accommodate the user's smaller breast to even them up.

Hence, the importance to monitor oneself with timed increments of seconds and minutes. This lack of a timing function has prevented prior devices from expanding breast tissue in symmetrical portions.

Referring to FIG. 9, this figure shows that once a vacuum has been created, the user can now free her hands from the hollow dome 20 and valve-timer 25 for the required length of time she has selected on the digital timer 26.

Thus, it is apparent that a new and non-obvious device for expanding breast tissue and nipples has been provided by the present invention which allows any user the opportunity to expand breast tissue more efficiently, conveniently and safely than does the prior art.

SUMMARY

Accordingly, the reader will see this respiratory breast tissue expanding device can generate suction without the need for dangerous and cumbersome mechanical vacuum pressure generators. In addition, this respiratory breast expanding device has a timing function to ensure safety and consistency of training and to assure retention of vacuum for a controlled period of time. Furthermore, this respiratory breast tissue expanding device has additional advantages in that:

It provides a breast tissue expansion device which has the ability to decrease the amount of treatment time required to expand the size and firm the shape of female breast tissue.

It provides a breast tissue expansion device which has the ability to safely correct the condition of inverted breast nipples.

It provides an improved breast tissue expansion device that is easy to disassemble and sanitize.

It provides an improved breast tissue expansion device that is low cost, durable and easy to use.

It provides an improved hollow dome of a breast tissue expansion device that is light weight, pliable and allows the user to position the hollow dome to specifically uplift breast tissue to enhance appearance of breast cleavage.

It provides a breast tissue expansion device that incorporates a timing function which enables women to control the correct amount of device use needed to develop symmetrical breasts.

It provides a respiratory breast expansion device that is light weight in design providing mobility which allows the user's hands to be free for other activities while the device is performing its task.

It provides a respiratory breast expansion device that because it is light weight in design allows the user to maintain a regular exercise program while traveling.

It provides a respiratory breast expansion device that helps the user to develop her pectoral muscular platform as the result of generating suction by increased respiratory exercise.

It helps fill the internal fibro-connective fatty tissue of the breast with lymph fluids to diminish unwanted stretch-marks.

While a preferred embodiment of the present invention has been described in detail, various modifications, alterations and changes may be made without departing from the spirit and scope of the present invention is claimed as new and desired to be protected by Letters Patent as defined in the appended claims.

I claim:

1. A respiratory breast tissue expanding device comprising;

a hollow lightweight hemispherical dome of pliable, solid polyethylene construction, wherein the dome has an apex, a circumferential base, an inner surface beneath the dome, an outside surface on top of the dome; and wherein the dome has a rim, extending around the base and a threaded nipple with a passage through the top and outside surface of the dome at the apex thereof; and wherein a pliable tube having and interior, an exterior and two ends is releasably connected to said threaded nipple via corresponding threads on a first tube end, and releasably connected to a mouthpiece at the second tube end, said mouthpiece adapted for insertion into a user's mouth and having a passageway for air communication with the pliable tube, and wherein the valve timer is equipped with a closure slit in communication with the opening and the tube is positioned within the opening for selective movement between the opening and the closure slit when the tube is within the opening, the interior of the tube forming a passage for air when the tube is within the opening, the interior of the tube being squeezed sufficiently by the slit to block any passage of air within the interior of the tube; and wherein the tube extends through an opening in a valve timer between its first and second end connections with said valve timer; and wherein said valve timer is mounted to the tube in a position for maintaining selective movement of the tube between the opening and the closure slit and has a timing means for measuring and displaying time in minutes and seconds;

and wherein when the mouthpiece is connected to the tube and the tube is connected to the nipple, suction through the mouthpiece will develope a vacuum beneath the dome;

and wherein the total combined weight of the dome, nipple, rim, valve timer, tube and mouthpiece is less than three ounces.

2. The device as set forth in claim 1, wherein the threaded nipple extends perpendicularly relative to the outside surface of the dome.

3. The device as set forth in claim 1, wherein the rim is pliable solid polyethylene and has a surface which is textured to provide an airtight seal with the skin upon the introduction of a vacuum beneath the dome.

4. The device as set forth in claim 1, wherein the valve timer has a start button and a reset stop button and wherein the timing means is responsive to activation of the start button and to the reset button, to start measuring time and stop measuring time, respectively, and wherein the timing means includes a digital display of measured minutes and seconds.

5. The device as set forth in claim 1, wherein the opening and closure slit of the valve timer are arranged on the valve timer such that movement of the tube from one position to the other can be easily achieved with one hand, while the apparatus is in use.

* * * * *